US011177593B2

(12) United States Patent
Goh et al.

(10) Patent No.: US 11,177,593 B2
(45) Date of Patent: Nov. 16, 2021

(54) CONNECTOR

(71) Applicant: Molex, LLC, Lisle, IL (US)

(72) Inventors: Han-Lin Goh, Jurong Town (SG); Daw-Wei Lee, Jurong Town (SG); Ser-Kiat Toh, Jurong Town (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/886,917

(22) Filed: May 29, 2020

(65) Prior Publication Data

US 2020/0388944 A1 Dec. 10, 2020

(30) Foreign Application Priority Data

May 30, 2019 (CN) ..... 201920804357.3

(51) Int. Cl.

| | |
|---|---|
| ***H01R 13/648*** | (2006.01) |
| ***H01R 12/71*** | (2011.01) |
| ***H01R 13/6591*** | (2011.01) |
| ***H01R 13/6581*** | (2011.01) |
| ***H01R 13/514*** | (2006.01) |

(52) U.S. Cl.

CPC ..... *H01R 12/718* (2013.01); *H01R 13/514* (2013.01); *H01R 13/6581* (2013.01); *H01R 13/6591* (2013.01)

(58) Field of Classification Search

CPC .. H01R 12/712; H01R 12/716; H01R 12/718; H01R 13/514; H01R 13/6581; H01R 13/6591

USPC ..... 439/79, 607.01

See application file for complete search history.

(56) References Cited

U.S. PATENT DOCUMENTS

| | | | |
|---|---|---|---|
| 6,899,566 | B2 | 5/2005 | Kline et al. |
| 8,690,604 | B2 | 4/2014 | Davis |
| 9,331,407 | B2 | 5/2016 | Laurx et al. |
| 2008/0203547 | A1 | 8/2008 | Minich |

*Primary Examiner* — Khiem M Nguyen

(57) ABSTRACT

The present disclosure provides a connector that comprises a housing and wafers. The housing comprises a top wall and a bottom wall separated from each other in a mounting direction. The wafers are mated to the housing in a mating direction and supported by the housing. A first wafer is configured to be limited in the mounting direction. A second wafer is configured to be limited in the mating direction. A possible benefit from a match between a limiting block of the first wafer and a limiting groove of the housing and a match between the limiting block of the first wafer and a limiting opening of the housing is that the first wafer is less easy to move between the top wall and the bottom wall of the housing along the mounting direction and can be more firmly supported by the housing.

17 Claims, 16 Drawing Sheets

CONNECTOR

RELATED APPLICATION

This application claims priority to Chinese Application Serial No. 201920804357.3, filed on May 30, 2019, which is incorporated by reference in its entirety.

TECHNICAL FIELD

The present disclosure relates to a connector, particularly relates to a right angle connector.

BACKGROUND

U.S. Pat. No. 8,690,604 discloses a connector. A frame assembly of the connector includes a first dielectric frame and a second dielectric frame. The first dielectric frame and the second dielectric frame are basically similar to each other. For example, the first dielectric frame and the second dielectric frame are generally mirror symmetry in the frame assembly. The first dielectric frame and the second dielectric frame are mated to an outer housing along a mating direction, and the first dielectric frame and the second dielectric frame are limited in the outer housing in the mating direction via a holding member. However, the holding member does not limit the first dielectric frame and the second dielectric frame in the outer housing in a mounting direction, wherein a top wall and a bottom wall of the outer housing are separated in the mounting direction. Therefore, in a mounting process, for example mounting a circuit board to the connector in the mounting direction, the first dielectric frame and the second dielectric frame may shake between the top wall and the bottom wall of the outer housing along the mounting direction, and cannot be firmly supported by the outer housing.

U.S. Pat. No. 9,331,407 discloses a connector. The connector includes wafers and a housing supporting the wafers. However, the patent does not teach or suggest a limiting structure between the wafers and the housing. Therefore, the wafers may shake between a top wall and a bottom wall of the housing in a mounting direction and/or a mating direction and cannot be firmly supported by the housing United States patent application publication No. US2008/0203,547A1 discloses a connector. The connector includes a leadframe housing and a connector housing. The leadframe housing includes a holding member. The connector housing includes a holding groove. When mating, a single leadframe housing is limited in the connector housing by engaging the holding member into the holding groove. The patent does not teach to limit the leadframe housings in the connector housing via the holding member of a single leadframe housing. In addition, the holding groove and the holding member are merely used to limit the leadframe housing in the connector housing in a mounting direction. The patent does not teach a limiting structure used to limit the leadframe housing in the connector housing in a mating direction. Therefore, the leadframe housing can not be firmly supported by the connector housing.

U.S. Pat. No. 6,899,566 discloses a connector. The connector includes a terminal module and an insulated housing. The terminal module includes a bracket. The insulated housing includes a module support bracket. The bracket includes a V-shaped wedge. When mating, the V-shaped wedge is slidably received within a corresponding inverted V-shape within a notch in the module support bracket. The V-shaped wedge and the notch cooperate to insure precise alignment between the terminal module and the insulated housing. However, the patent does not teach a limiting structure used to limit the terminal module in the insulated housing in a mating direction. Therefore, the terminal module may be not firmly supported by the insulated housing.

The description in background as above merely is used to provide a background art, and it does not admit that the description in background as above discloses the object of the present disclosure, and do not constitute a prior art of the present disclosure, and any description in background as above shall not be acted as any part of the present disclosure.

SUMMARY

In an embodiment, the present disclosure provides a connector. The connector comprises a housing and wafers. The housing comprises a top wall and a bottom wall separated with each other in a mounting direction. The wafers are mated to the housing in a mating direction and supported by the housing. The wafers comprise a first wafer and a second wafer. The first wafer is configured to be limited in the mounting direction. The second wafer is configured to be limited in the mating direction. Response to that the first wafer is limited in the mounting direction, the second wafer is limited in the mounting direction. Response to that the second wafer is limited in the mating direction, the first wafer is limited in the mating direction.

In some embodiments, each of the top wall and the bottom wall of the housing comprises a first limiting structure and a second limiting structure. Each of a top portion and a bottom portion of the first wafer comprises a first mate limiting structure configured to be matched with the first limiting structure so as to limit the first wafer in the mounting direction. Each of a top portion and a bottom portion of the second wafer comprises a second mate limiting structure configured to be matched with the second limiting structure so as to limit the second wafer in the mating direction.

In some embodiments, the first wafer and the second wafer are retained with each other.

In some embodiments, the connector further comprises a retaining piece. The retaining piece is configured to retain the first wafer and the second wafer with each other.

In some embodiments, the first limiting structure comprises a top end and a bottom end separated with each other along the mounting direction, widths of the top end and the bottom end in an arranging direction of the wafers are different from each other.

In some embodiments, when the first limiting structure does not pass through the top wall or the bottom wall in the mounting direction, the first limiting structure comprises a limiting groove.

In some embodiments, when the first limiting structure passes through the top wall or the bottom wall in the mounting direction, the first limiting structure comprises a limiting opening In some embodiments, the first mate limiting structure comprises a limiting block.

In some embodiments, the second mate limiting structure comprises a latching block.

In some embodiments, a shape of the first limiting structure and a shape of the first mate limiting structure comprise T-shape, V-shape or dovetail shape.

In some embodiments, the second limiting structure comprises a latching groove and a latching hole communicated with the latching groove. When the latching hole does not pass through the top wall or the bottom wall in the mounting direction, the latching hole comprises a blind hole.

In some embodiments, the second limiting structure comprises a latching groove and a latching hole communicated with the latching groove, when the latching hole pass through the top wall or the bottom wall in the mounting direction, the latching hole comprises a through hole.

In some embodiments, each of the first wafer and the second wafer comprises an insulating frame and terminals fixed with the insulating frame.

In some embodiments, the terminals comprise at least a signal terminal pair and at least a ground terminal.

In some embodiments, each of the first wafer and the second wafer further comprises a shield member electrically connected the ground terminal.

In some embodiments, the connector further comprises an isolating plate positioned between the first wafer and the second wafer.

In some embodiments, the isolating plate is provided in the second wafer, the shield member of the second wafer is positioned between the terminals of the second wafer and the isolating plate.

In an embodiment of the present disclosure, benefits from a match between the limiting block of the first wafer and the limiting groove of the housing and a match between the limiting block of the first wafer and the limiting opening of the housing, the first wafer is less easy to shake between the top wall and the bottom wall of the housing along the mounting direction, and can be more firmly supported by the housing. In addition, the first wafer and the second wafer are retained with each other, so the second wafer is similarly less easy to shake between the top wall and the bottom wall of the housing along the mounting direction, and can be more firmly supported by the housing. Moreover, benefits from a lock between the latching blocks of the second wafer and the latching holes of the housing, the second wafer is less easy to shake between the top wall and the bottom wall of the housing along the mating direction, and can be more firmly supported by the housing. In addition, the first wafer and the second wafer are retained with each other, so the first wafer is similarly less easy to shake between the top wall and the bottom wall of the housing along the mating direction, and can be more firmly supported by the housing.

Technical features and advantages of the present disclosure are widely generalized as above, so as to better understand the following detailed description of the present disclosure. Other technical features making up objects of the claims of the present disclosure and other advantages will be described below. A person skilled in the art of the present disclosure shall understand that the concept and specific embodiments disclosed below may be easily used to modify or design other configuration or manufacturing approach so as to realize the same object as the present disclosure. A person skilled in the art of the present disclosure shall also understand that, such an equivalent configuration cannot be departed from the spirit and scope of the present disclosure defined by the appended claims.

BRIEF DESCRIPTION OF THE DRAWINGS

The various respects of the present disclosure may be best understood by the following detailed description in combination with the accompanying figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclosed content provides various embodiments or exemplifications used to implement various features of the present disclosure. Specific examples of elements and configurations are described as follows, so as to simplify the disclosed content of the present disclosure. Certainly, these are merely examples, and are not used to limit the present disclosure. For example, in the following description, that a first feature is formed on or above a second feature may include an embodiment that the first feature and the second feature are formed to directly contact with each other, may also include an embodiment that other feature is formed between the first feature and the second feature, therefore the first feature and the second feature do not directly contact with each other. Moreover, the present disclosure may allow a symbol and/or a character of an element to be repeated in different examples. The repetition is used for simplification and clearness but is not used to dominate a relationship between various embodiments and/or discussed structures.

Moreover, the present disclosure may use spatial corresponding terminologies, such as simple express of "below", "lower than", "relative lower", "higher than", "relative high" and the like, so as to describe a relationship between an elements or feature and another element or feature in figures. Spatial corresponding terminologies are used to include various orientations of a device in use or operation besides orientations illustrated in figures. The device may be orientated (rotated by 90 degrees or in other orientation), and the corresponding spatial description in the present disclosure may be correspondingly explained. It should be understood that, when a feature is formed to another feature or above a substrate, other feature may presented between them.

In the following description, the direction indicated by X1-X2 in FIGS. 1 to 17 is referred to as a mating direction, the direction indicated by Y1-Y2 in FIGS. 1 to 17 is referred to as an arranging direction, the direction indicated by Z1-Z2 in FIGS. 1 to 17 is referred to as a mounting direction. These directions are used to explain the relative positional relationship and the relative action of each assembly in FIGS. 1 to 17. That is, these directions are not absolute, but are relative. Therefore, these directions do not limit the orientation when using each assembly in FIGS. 1 to 17. The directions described in the present disclosure should be interpreted as changing in accordance with a change in the orientation of each assembly in FIGS. 1 to 17.

Figure 1:
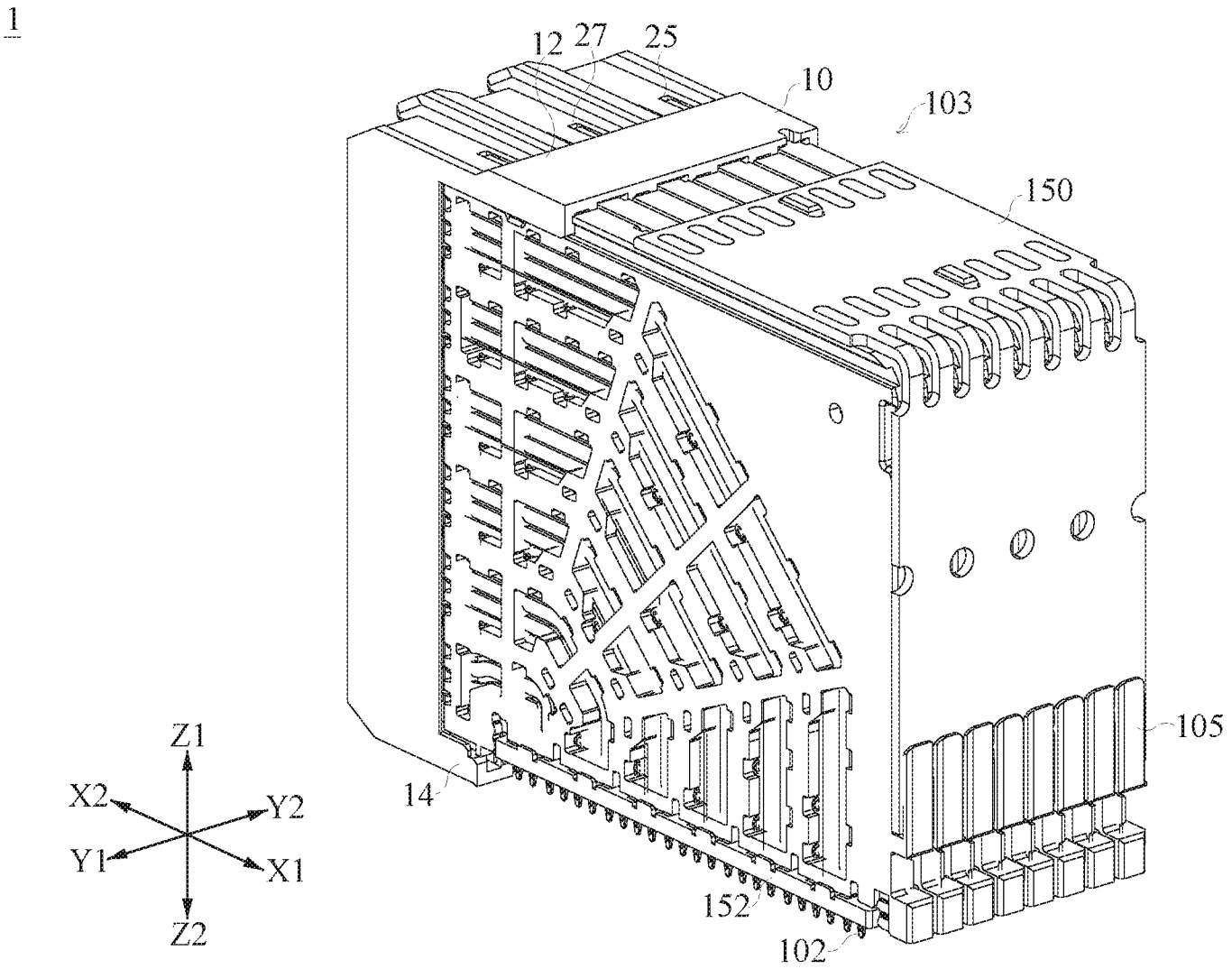
FIG. 1 illustrates a perspective schematic view of an embodiment of a connector.
Figure 2:
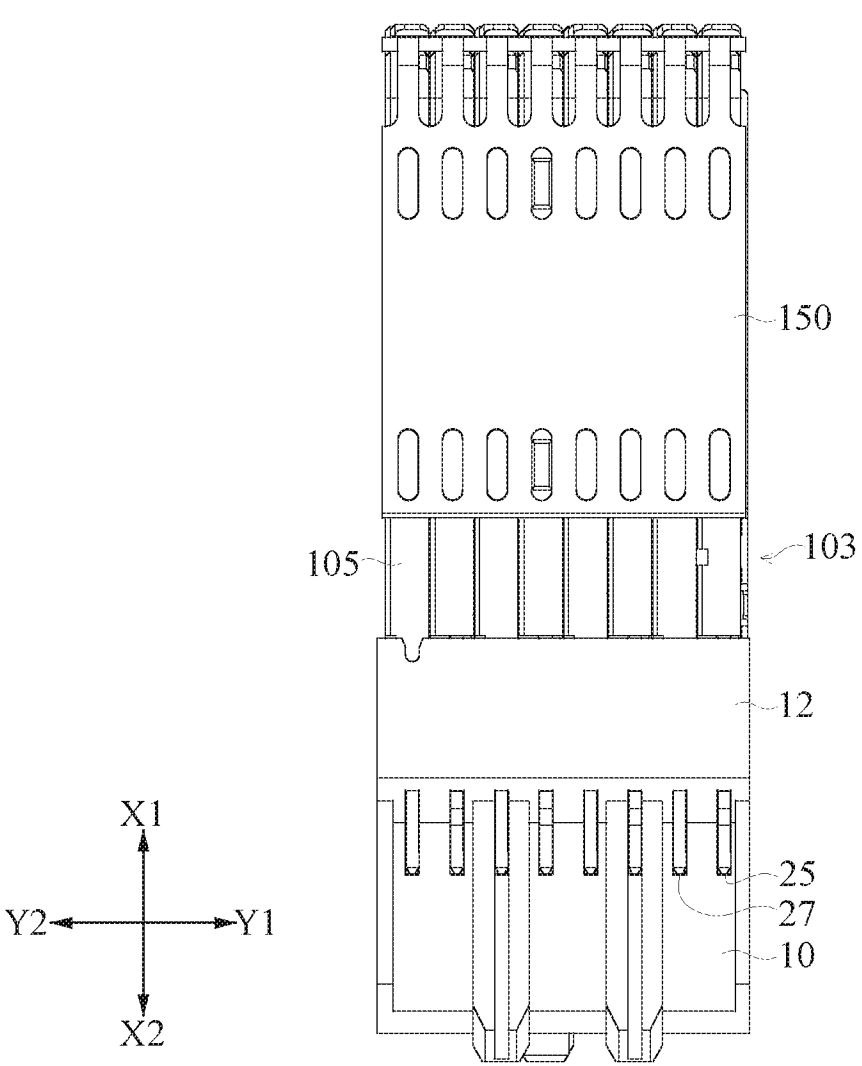
FIG. 2 illustrates a top plan schematic view of an embodiment of the connector shown in FIG. 1.
Figure 3:
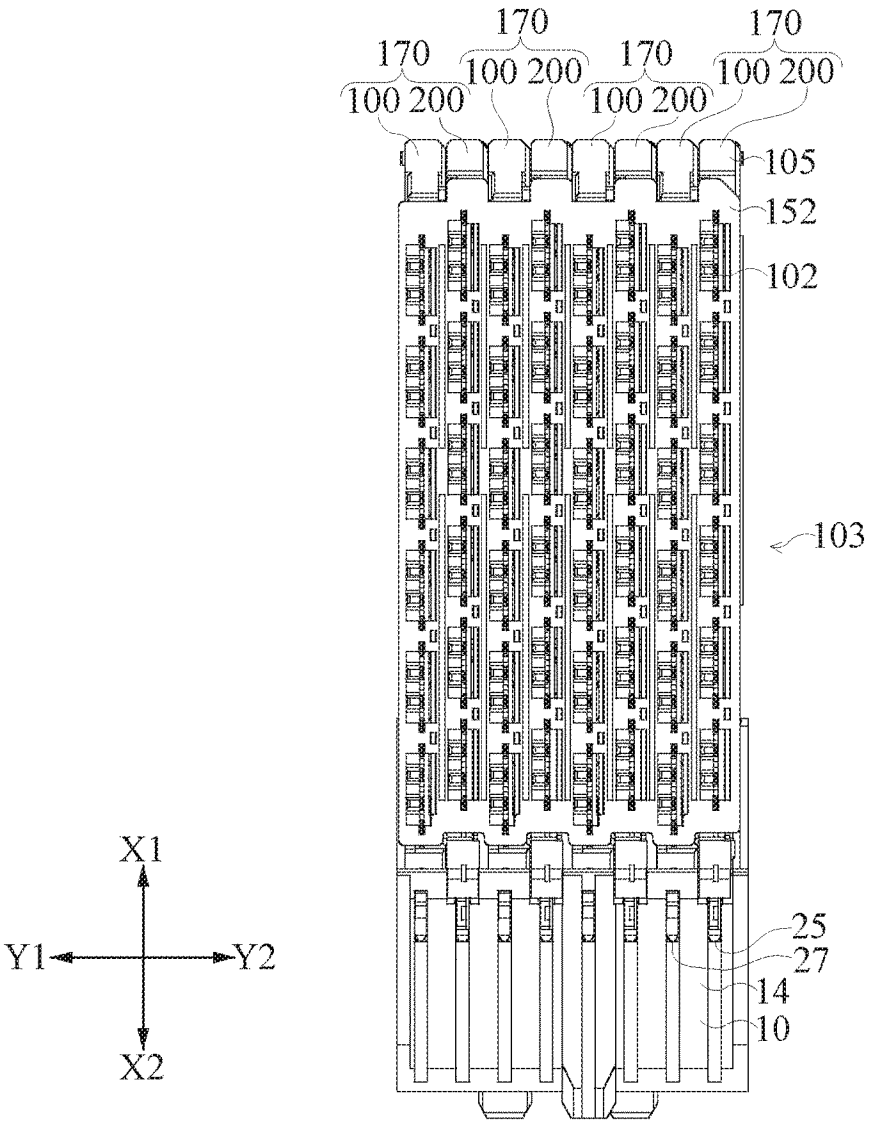
FIG. 3 illustrates a bottom plan schematic view of an embodiment of the connector shown in FIG. 1.
Figure 4:
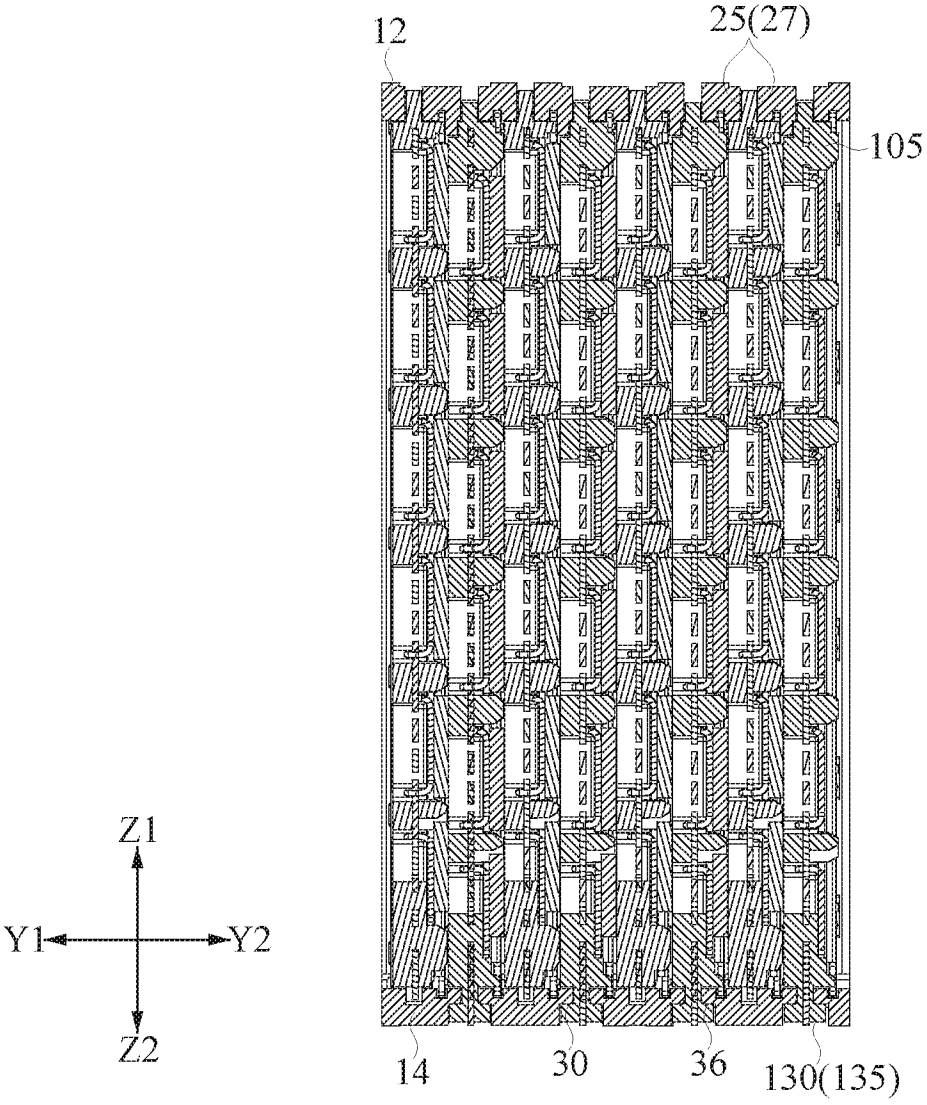
FIG. 4 illustrates a cross-sectional schematic view of the connector shown in FIG. 1, in which a terminal mounting base shown in FIG. 1 is not cut.
Figure 5:
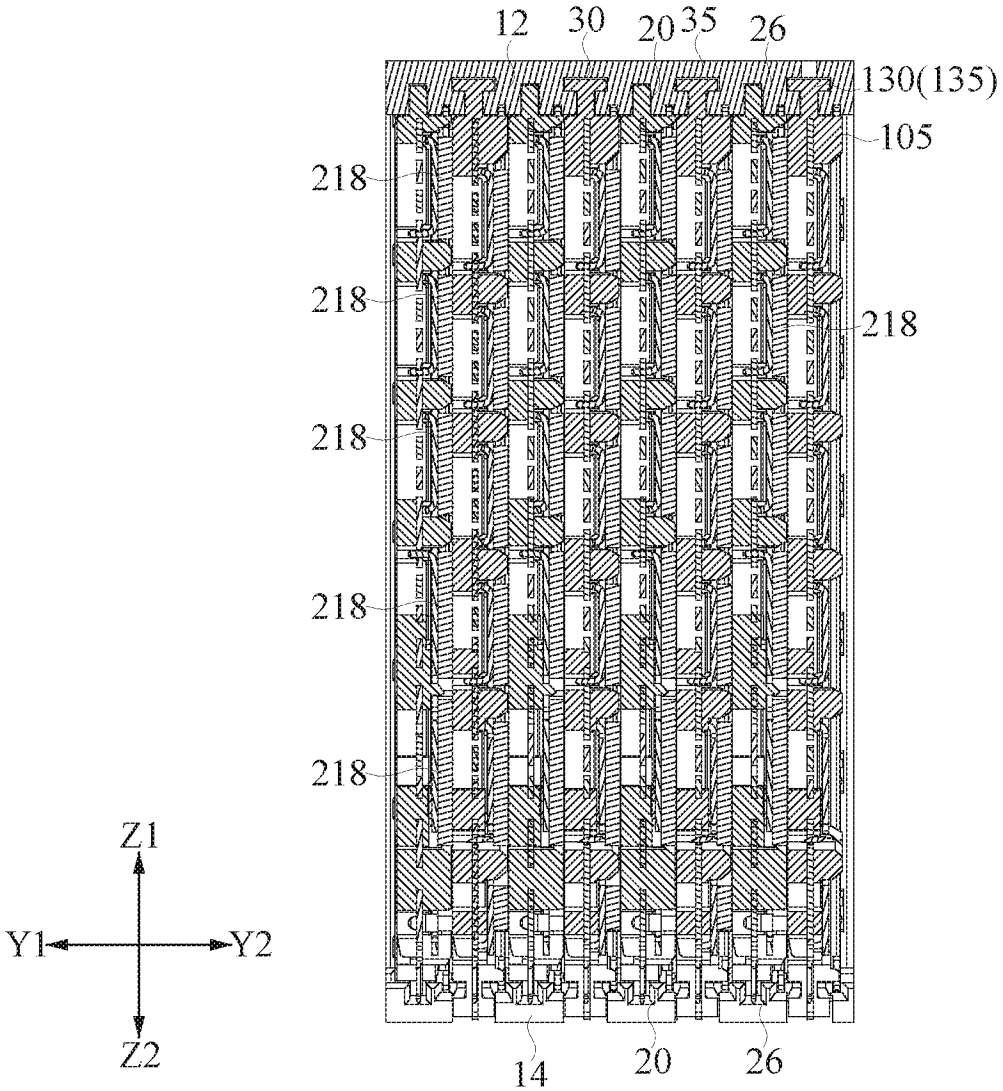
FIG. 5 illustrates another cross-sectional schematic view of the connector shown in FIG. 1, in which the terminal mounting base shown in FIG. 1 is not cut.

FIG. 1 illustrates a perspective schematic view of an embodiment of a connector 1. FIG. 2 illustrates a top plan schematic view of an embodiment of the connector 1 shown in FIG. 1. FIG. 3 illustrates a bottom plan schematic view of an embodiment of the connector 1 shown in FIG. 1. FIG. 4 illustrates a cross-sectional schematic view of the connector 1 shown in FIG. 1, in which a terminal mounting base 152 shown in FIG. 1 is not cut. FIG. 5 illustrates another cross-sectional schematic view of the connector 1 shown in FIG. 1, in which the terminal mounting base 152 shown in FIG. 1 is not cut. In some embodiments, the connector 1 is a right angle connector. Referring to FIG. 1, the connector 1 includes a housing 10 and a wafer assembly 103 mated to the housing 10.

Figure 6:
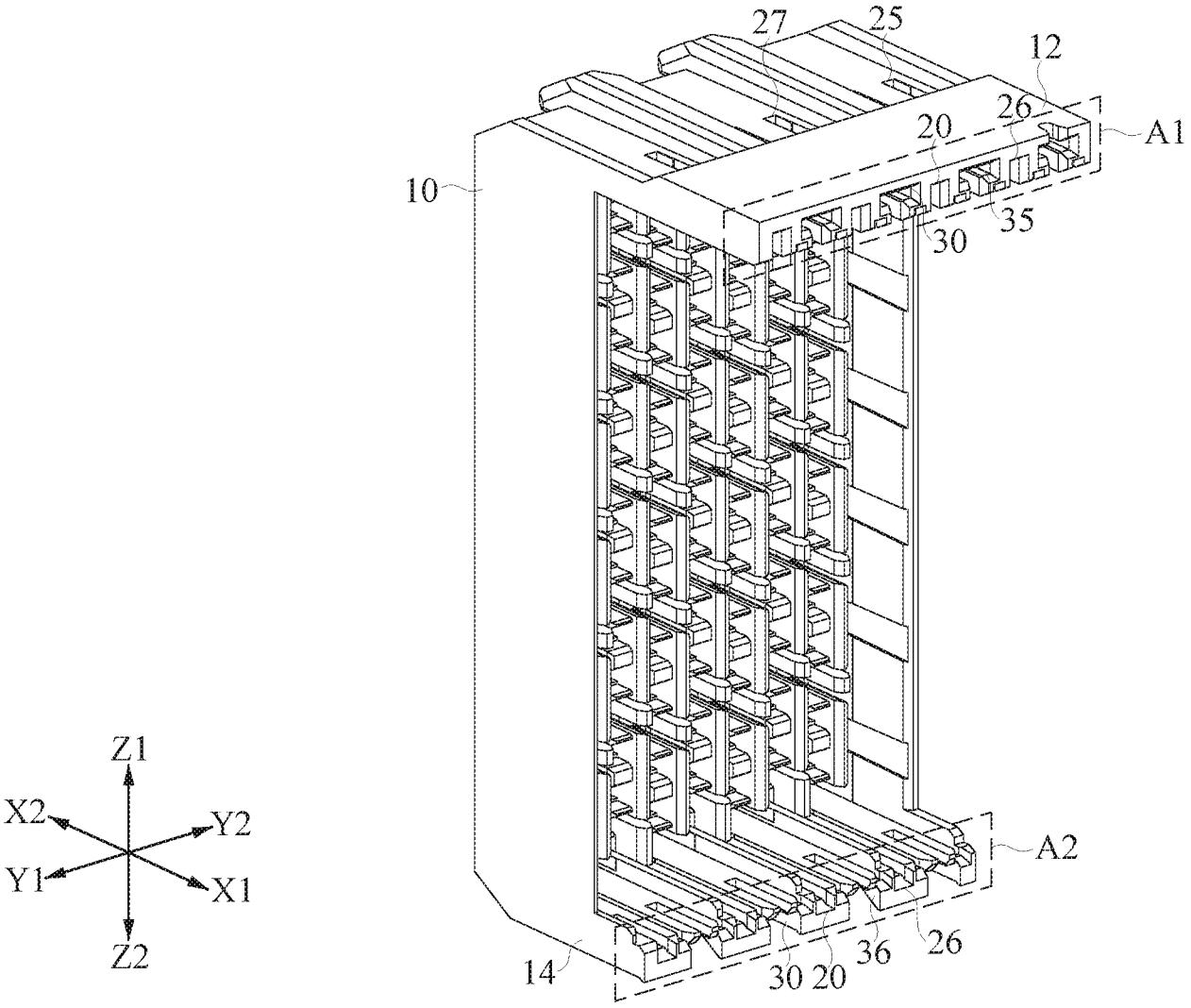
FIG. 6 illustrates a perspective schematic view of an embodiment of a housing shown in FIG. 1.
Figure 7:
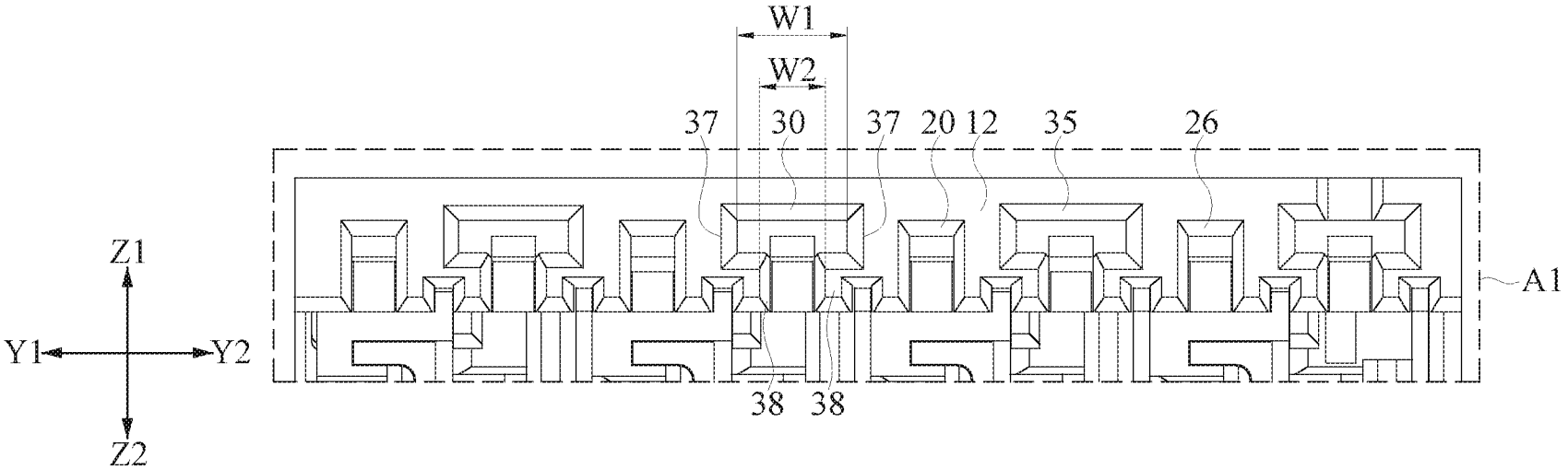
FIG. 7 illustrates a partially enlarged perspective schematic view of a region of the housing shown in FIG. 6.
Figure 8:
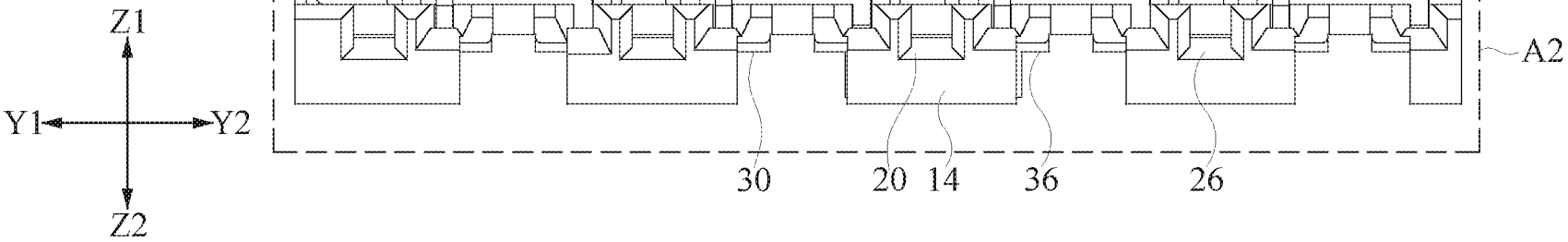
FIG. 8 illustrates a partially enlarged perspective schematic view of another region of the housing shown in FIG. 6.

FIG. 6 illustrates a perspective schematic view of an embodiment of a housing 10 shown in FIG. 1. FIG. 7 illustrates a partially enlarged perspective schematic view of a region A1 of the housing 10 shown in FIG. 6. FIG. 8 illustrates a partially enlarged perspective schematic view of another region A2 of the housing 10 shown in FIG. 6. Referring to FIG. 6, the housing 10 includes a top wall 12 and a bottom wall 14 separated with each other in the mounting direction Z1-Z2. Each of the top wall 12 and the bottom wall 14 of the housing 10 includes a first limiting structure 30 and a second limiting structure 20 separated with each other in the arranging direction Y1-Y2. Hereinafter the first limiting structure 30 and the second limiting structure 20 of the top wall 12 and the first limiting structure 30 and the second limiting structure 20 of the bottom wall 14 will be respectively described in detail.

The first limiting structure 30 and the second limiting structure 20 of the top wall 12:

Referring to FIG. 7, the first limiting structure 30 includes a top end 37 and a bottom end 38 separated with each other along the mounting direction Z1-Z2, the top end 37 and the bottom end 38 respectively have a width W1 and a width W2, wherein the width W1 is different from the width W2. That is, the widths of the top end 37 and the bottom end 38 in the arranging direction Y1-Y2 are different from each other. In some embodiments, a shape of the first limiting structure 30 includes a T-shape, V-shape or a dovetail shape. The first limiting structure 30 of the top wall 12 does not pass through the top wall 12 in the mounting direction Z1-Z2, the first limiting structure 30 of the top wall 12 includes a limiting groove 35 extending in the mating direction X1-X2 accordingly.

Referring to FIG. 7, the second limiting structure 20 includes a latching groove 26 extending in the mating direction X1-X2 and a latching hole 25 (as shown in FIG. 1, FIG. 2 and FIG. 4) communicated with the latching groove 26. In this embodiment, the latching hole 25 passes through the top wall 12 (as shown in FIG. 1, FIG. 2 and FIG. 4) in the mounting direction Z1-Z2, the latching hole 25 includes a through hole 27 accordingly. However, the present disclosure is not limited thereto. In some embodiments, the latching hole 25 may not pass through the top wall 12 in the mounting direction Z1-Z2, the latching hole 25 includes a blind hole accordingly.

The first limiting structure 30 and the second limiting structure 20 of the bottom wall 14:

Referring to FIG. 8, the first limiting structure 30 and the second limiting structure 20 of the bottom wall 14 is similar to the first limiting structure 30 and the second limiting structure 20 of the top wall 12. Therefore, the same content will not be repeated here. The first limiting structure 30 of the bottom wall 14 passes through the bottom wall 14 in the mounting direction Z1-Z2, the first limiting structure 30 of the bottom wall 14 includes a limiting opening 36 accordingly In some embodiments, both of the first limiting structure 30 of the top wall 12 and the first limiting structure 30 of the bottom wall 14 include the limiting groove 35, but do not include the limiting opening 36. In some embodiments, both of the first limiting structure 30 of the top wall 12 and the first limiting structure 30 of the bottom wall 14 include the limiting opening 36, but do not include the limiting groove 35. Moreover, in some embodiments, both of the first limiting structure 30 of the top wall 12 and the first limiting structure 30 of the bottom wall 14 include the limiting opening 36 and the limiting groove 35.

Figure 9:
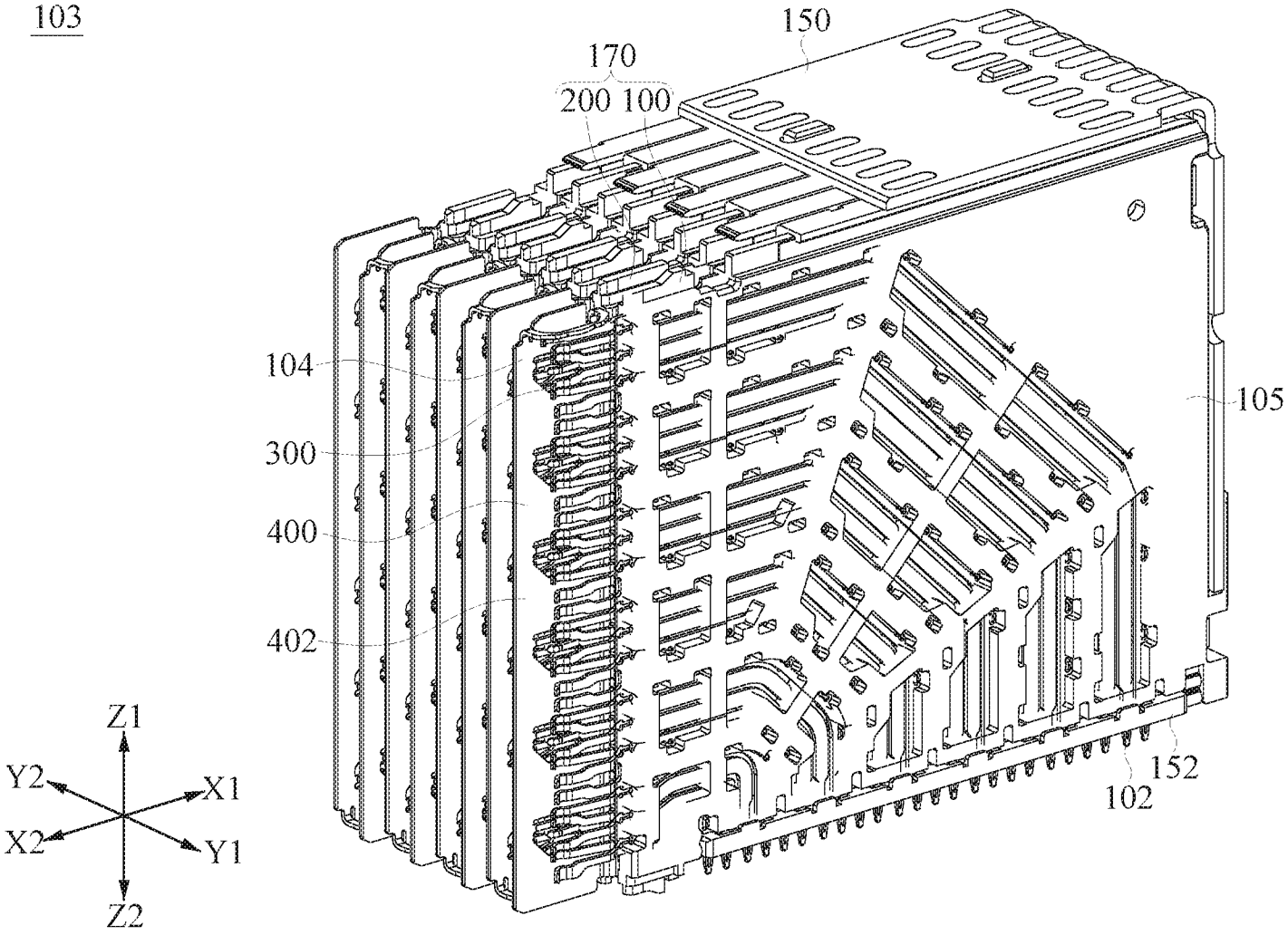
FIG. 9 illustrates an assembled perspective schematic view of a wafer assembly shown in FIG. 1.
Figure 10:
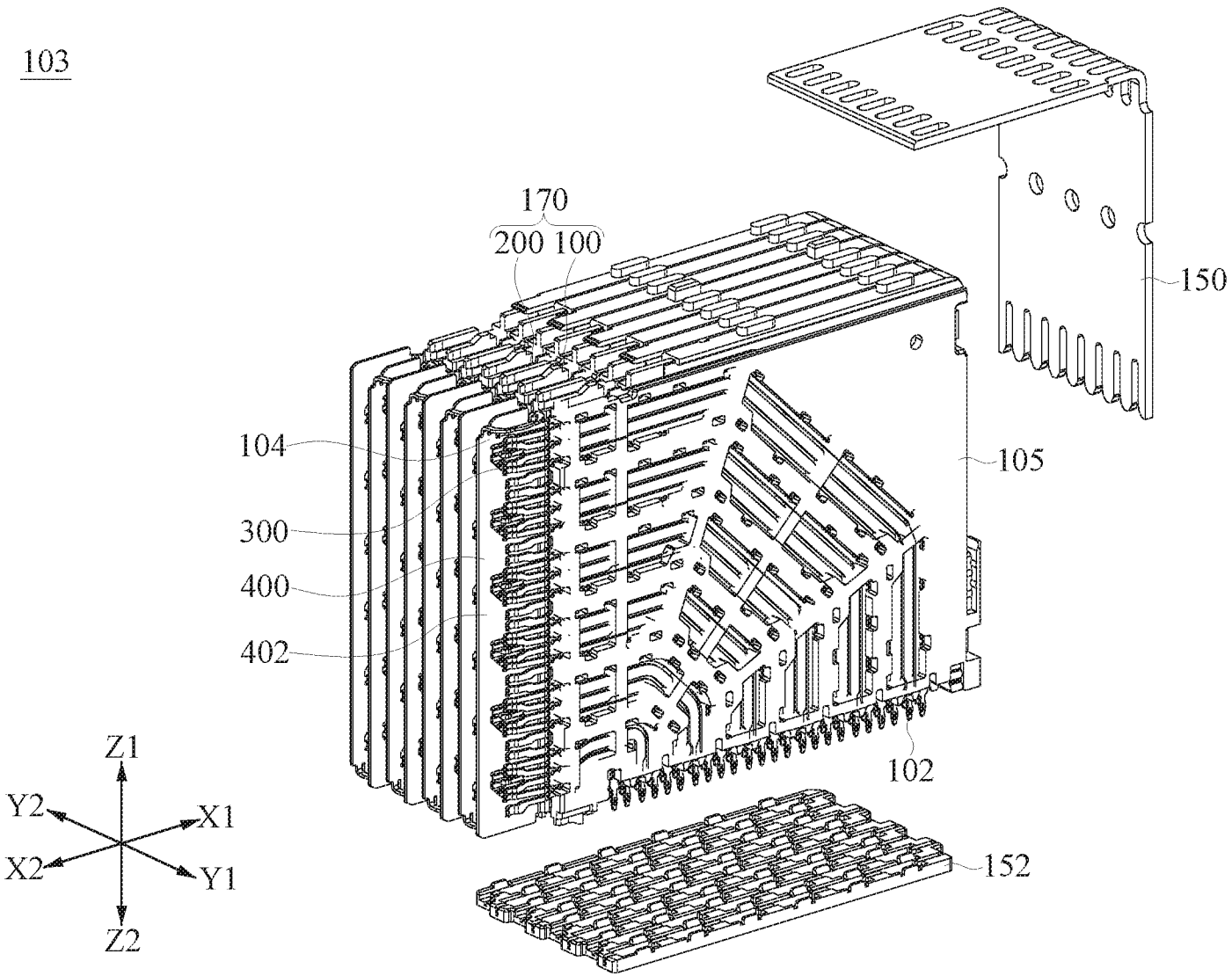
FIG. 10 illustrates an exploded perspective schematic view with respect to the wafer assembly shown in FIG. 9.

FIG. 9 illustrates an assembled perspective schematic view of a wafer assembly 103 shown in FIG. 1. FIG. 10 illustrates an exploded perspective schematic view with respect to the wafer assembly 103 shown in FIG. 9. Referring to FIG. 9 and FIG. 10, the wafer assembly 103 includes wafers 105 arranged along the arranging direction Y1-Y2, a retaining piece 150 retaining the wafers 105 and a terminal mounting base 152.

The wafers 105 are mated to the housing 10 (as shown in FIG. 1) along the mating direction X1-X2 and supported by the housing 10. The wafers 105 include wafer groups 170 (as shown in FIG. 3 and FIG. 9). Each wafer group 170 includes two wafer 105 (a first wafer 100 and a second wafer 200) retained with each other. Specifically, the first wafer 100 and the second wafer 200 are retained with each other via the retaining piece 150. However, the present disclosure is not limited to this. In some embodiments, the first wafer 100 and the second wafer 200 can be retained with each other in other ways.

The first wafer 100 is configured to be limited in the mounting direction Z1-Z2. The second wafer 200 is configured to be limited in the mating direction X1-X2. Because he first wafer 100 and the second wafer 200 are retained with each other, so response to that the first wafer 100 is limited in the mounting direction Z1-Z2, the second wafer 200 is limited in the mounting direction Z1-Z2, and response to that the second wafer 200 is limited in the mating direction X1-X2, the first wafer 100 is limited in the mating direction X1-X2, which are described in detail in FIGS. 11 to 16.

Figure 11:
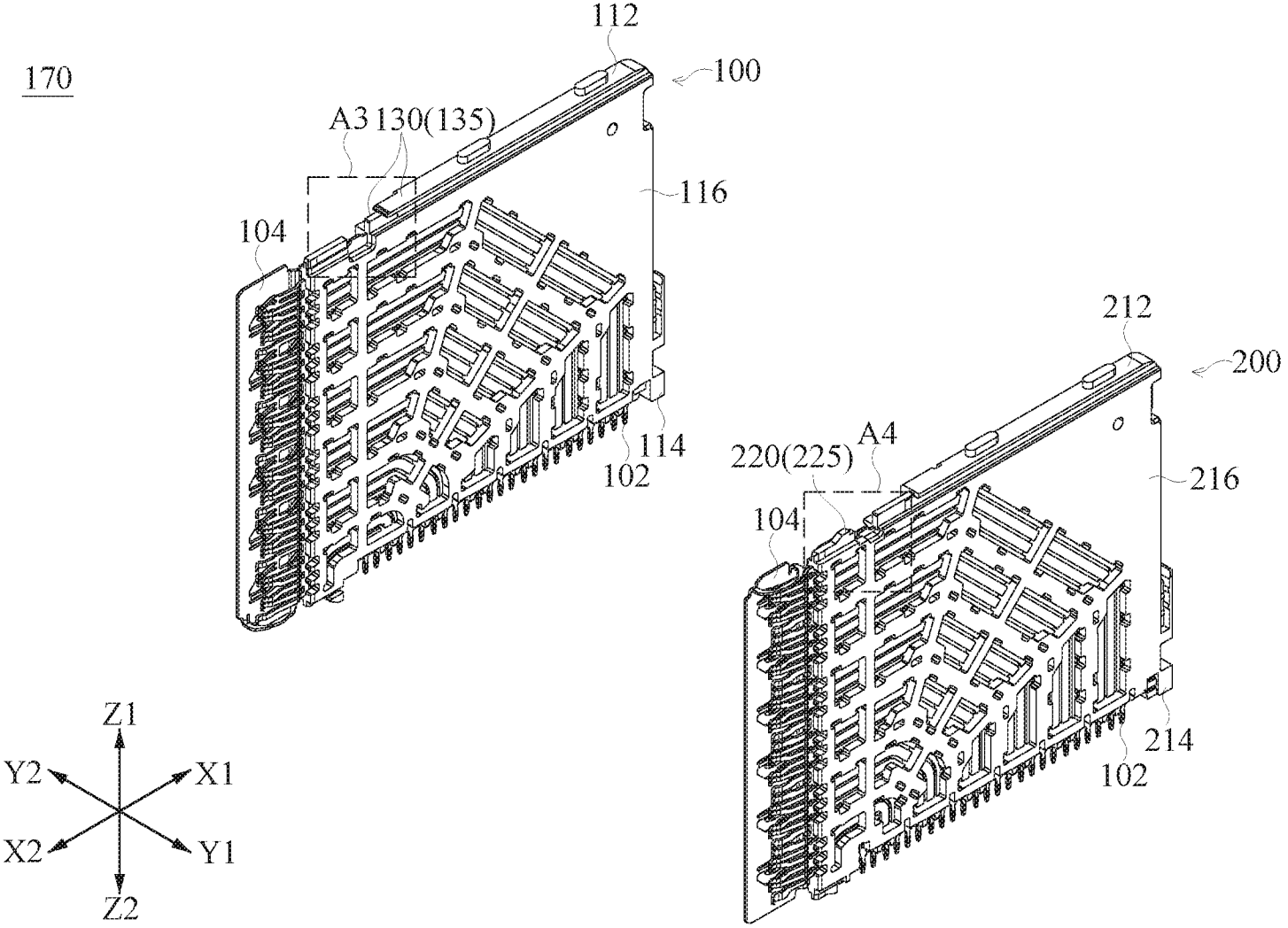
FIG. 11 illustrates an assembled perspective schematic view of a wafer group shown in FIG. 10.
Figure 12:
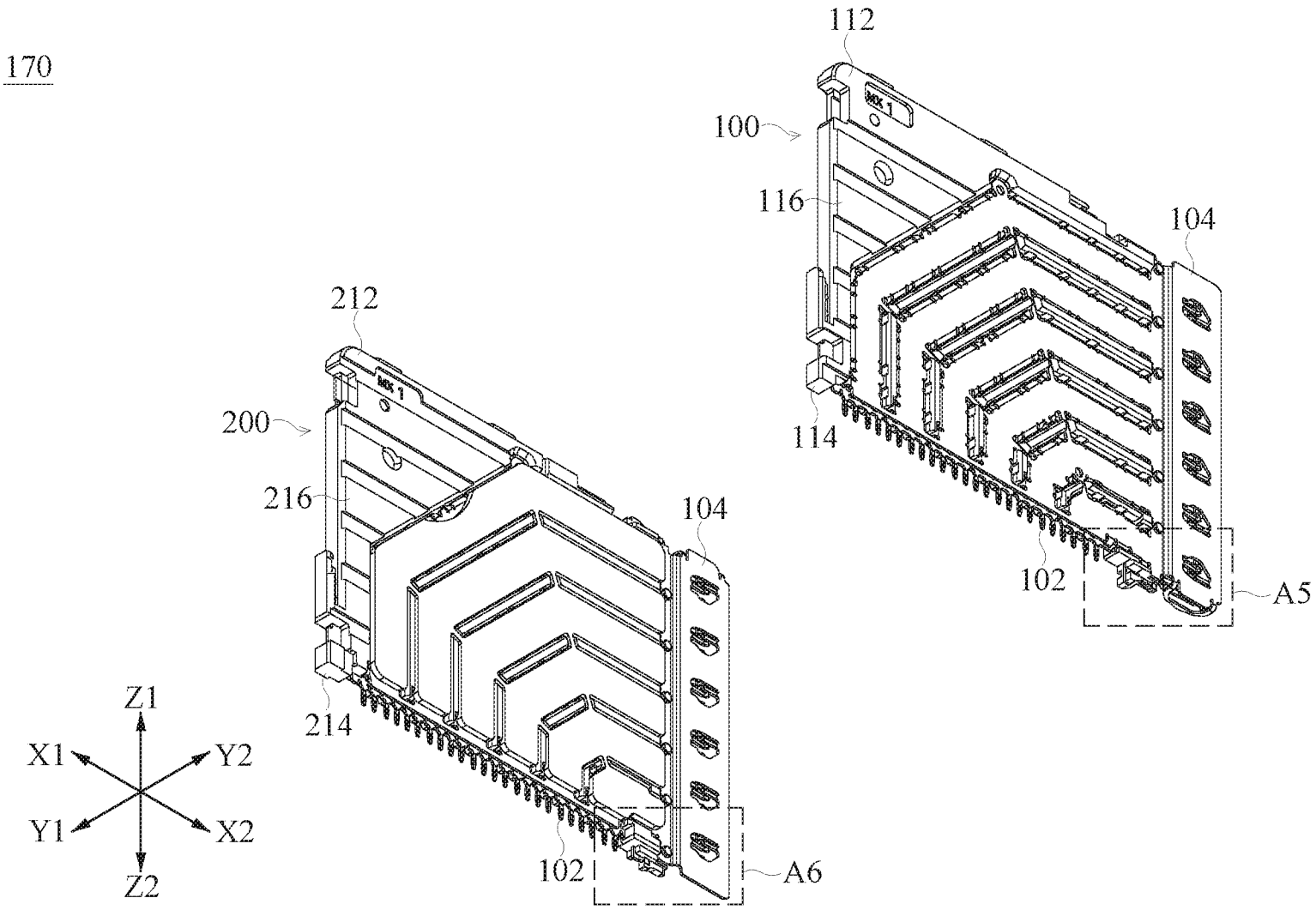
FIG. 12 illustrates an assembled perspective schematic view from another angle with respect to the wafer group shown in FIG. 11.
Figure 13:
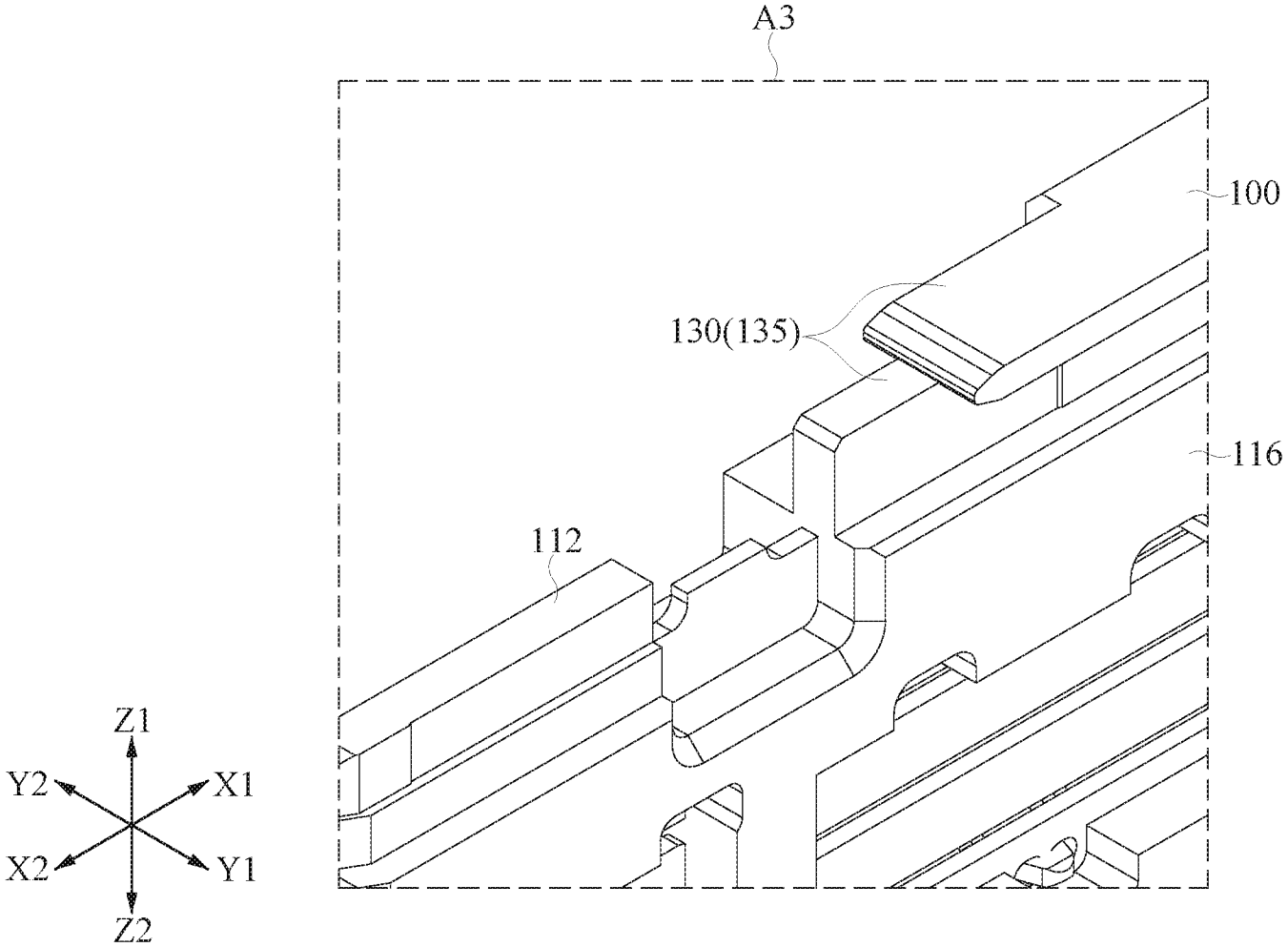
FIG. 13 illustrates a partially enlarged perspective schematic view of a region of a first wafer shown in FIG. 11.
Figure 14:
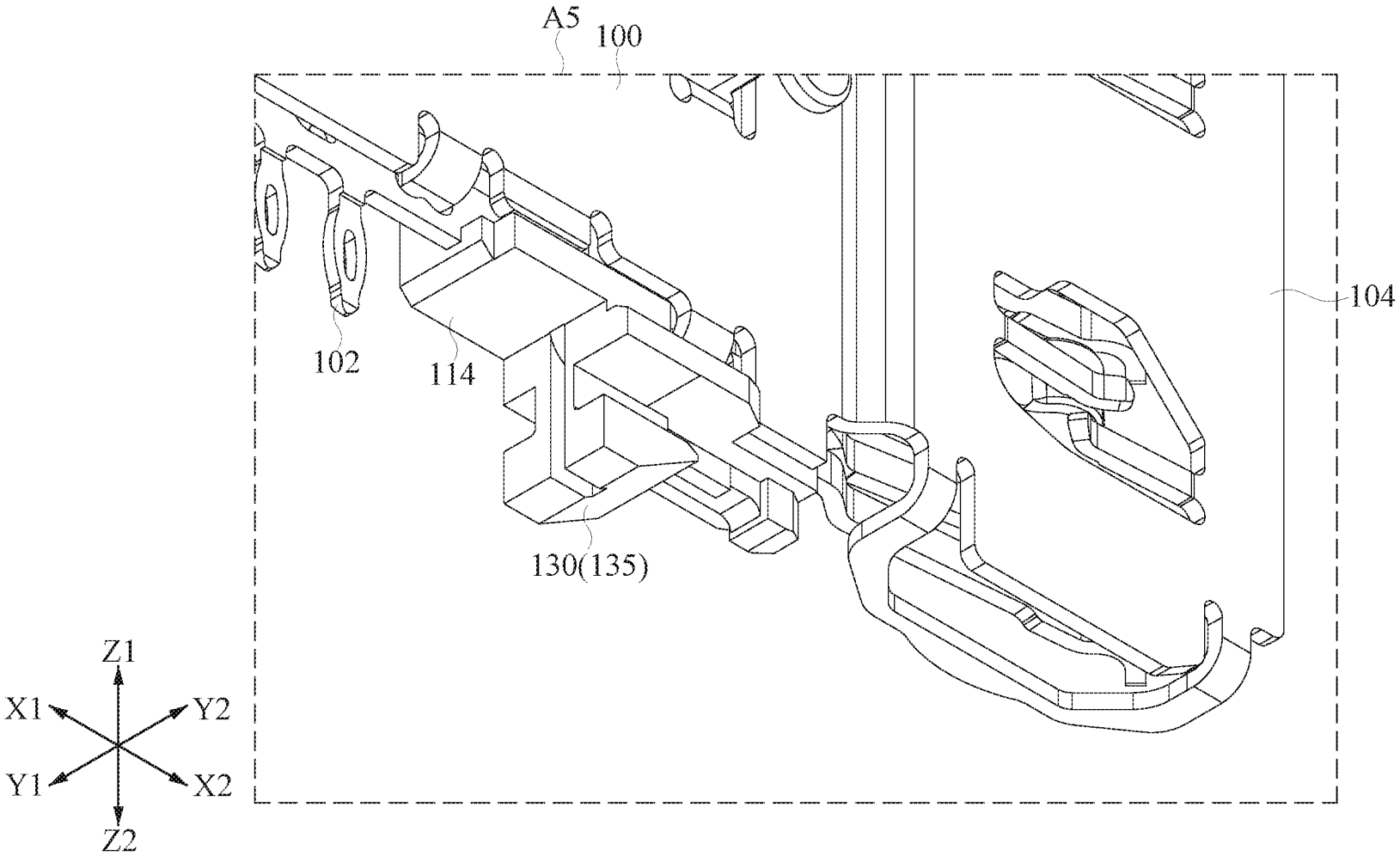
FIG. 14 illustrates a partially enlarged perspective schematic view of a region of the first wafer shown in FIG. 12.
Figure 15:
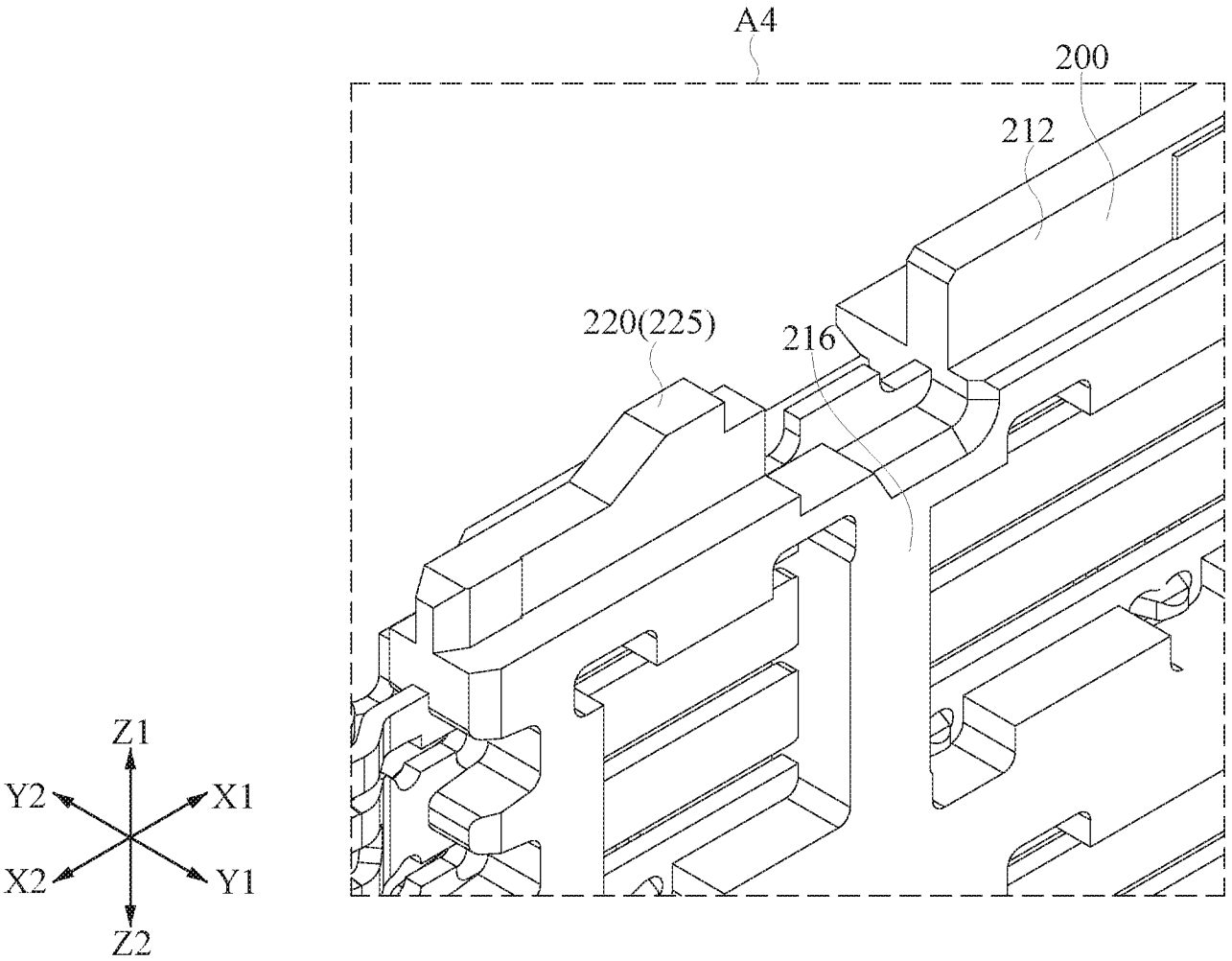
FIG. 15 illustrates a partially enlarged perspective schematic view of a region of a second wafer shown in FIG. 11.
Figure 16:
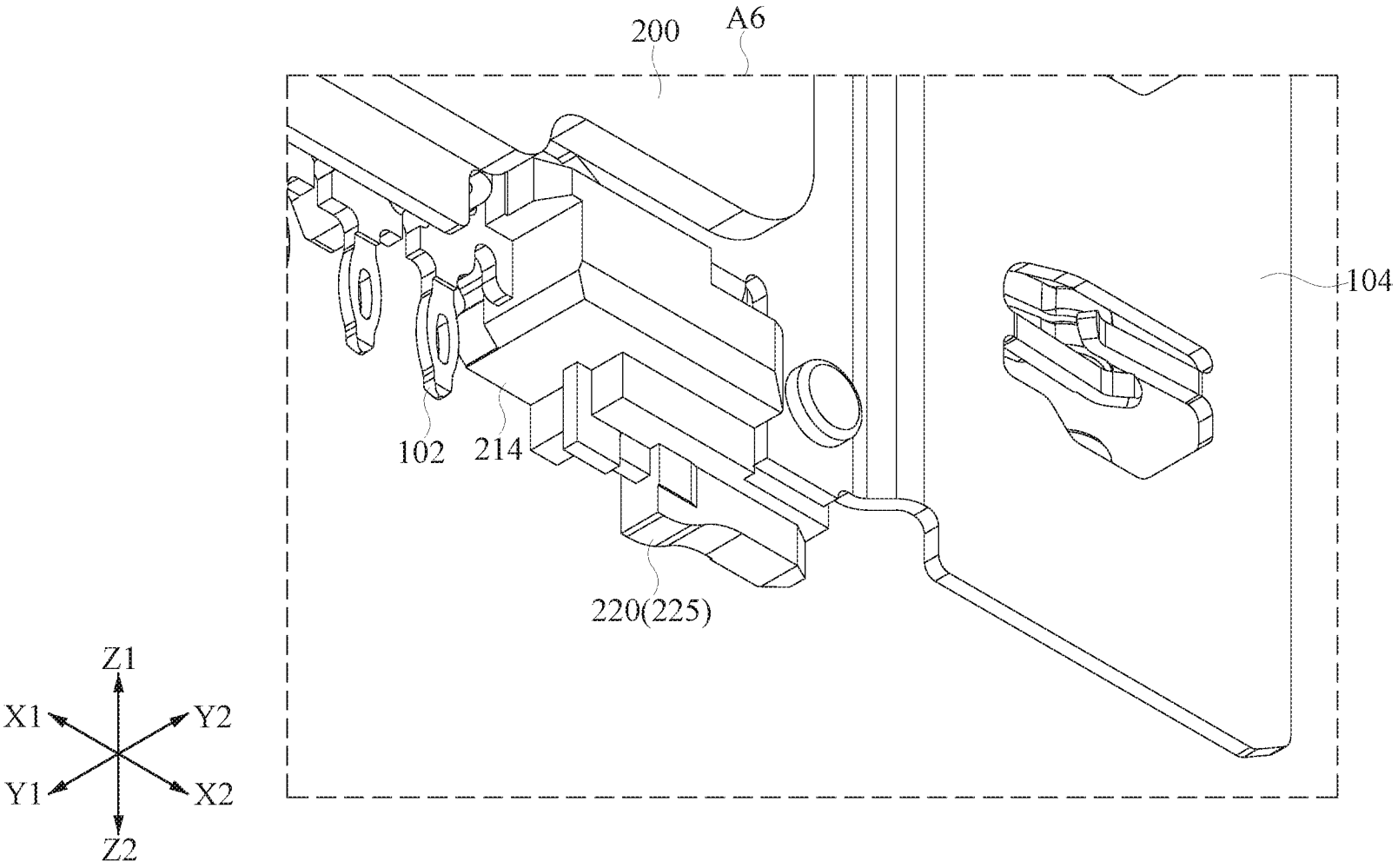
FIG. 16 illustrates a partially enlarged perspective schematic view of a region of the second wafer shown in FIG. 12.

FIG. 11 illustrates an assembled perspective schematic view of a wafer group 170 shown in FIG. 10. FIG. 12 illustrates an assembled perspective schematic view from another angle with respect to the wafer group 170 shown in FIG. 11. FIG. 13 illustrates a partially enlarged perspective schematic view of a region A3 of a first wafer 100 shown in FIG. 11. FIG. 14 illustrates a partially enlarged perspective schematic view of a region A5 of the first wafer 100 shown in FIG. 12. FIG. 15 illustrates a partially enlarged perspective schematic view of a region A4 of a second wafer 200 shown in FIG. 11. FIG. 16 illustrates a partially enlarged perspective schematic view of a region A6 of the second wafer 200 shown in FIG. 12.

Referring to FIG. 13 and FIG. 14, each of a top portion 112 and a bottom portion 114 of the first wafer 100 includes a first mate limiting structure 130. A shape of the first mate limiting structure 130 includes a T-shape. However, the present disclosure is not limited thereto. In some embodiments, the shape of the first mate limiting structure 130 may include a V-shape or a dovetail shape. The first mate limiting structure 130 is configured to be matched with the first limiting structure 30 of the housing 10 so as to limit the first wafer 100 in the mounting direction Z1-Z2.

Specifically, the first mate limiting structure 130 includes a limiting block 135. When the first wafer 100 is mated to the housing 10, the limiting block 135 of the top portion 112 of the first wafer 100 and the limiting groove 35 of the top wall 12 of the housing 10 are matched with each other, and the limiting block 135 of the bottom portion 114 of the first wafer 100 and the limiting opening 36 of the bottom wall 14 of the housing 10 are matched with each other. The top portion 112 and the bottom portion 114 of the first wafer 100 are not easy to move in the mounting direction Z1-Z2 respectively relative to the top wall 12 and the bottom wall 14 of the housing 10. Therefore, the first wafer 100 is less easy to shake between the top wall 12 and the bottom wall 14 of the housing 10 along the mounting direction Z1-Z2 and can be more firmly supported by the housing 10. In addition, the first wafer 100 and the second wafer 200 are retained with each other, so the second wafer 200 is similarly less easy to shake between the top wall 12 and the bottom wall 14 of the housing 10 along the mounting direction Z1-Z2, and can be more firmly supported by the housing 10.

Referring to FIG. 15 and FIG. 16, each of a top portion 212 and a bottom portion 214 of the second wafer 200 includes a second mate limiting structure 220. The second mate limiting structure 220 is configured to be matched with the second limiting structure 20 so as to limit the second wafer 200 in the mating direction X1-X2.

Specifically, the second mate limiting structure 220 includes a latching block 225. When the second wafer 200 is mated to the housing 10, the latching blocks 225 of the top portion 212 and the bottom portion 214 of the second wafer 200 are matched with the latching grooves 26 of the top wall 12 and the bottom wall 14 of the housing 10 and locked with the latching holes 25 of the top wall 12 and the bottom wall 14. The top portion 212 and the bottom portion 214 of the second wafer 200 are not easy to move in the mating direction X1-X2 respectively relative to the top wall 12 and the bottom wall 14 of the housing 10. Therefore, the second wafer 200 is less easy to shake between the top wall 12 and the bottom wall 14 of the housing 10 along the mating direction X1-X2, and can be more firmly supported by the housing 10. In addition, the first wafer 100 and the second wafer 200 are retained with each other, so the first wafer 100 is similarly less easy to shake between the top wall 12 and the bottom wall 14 of the housing 10 along the mating direction X1-X2, and can be more firmly supported by the housing 10.

Figure 17:
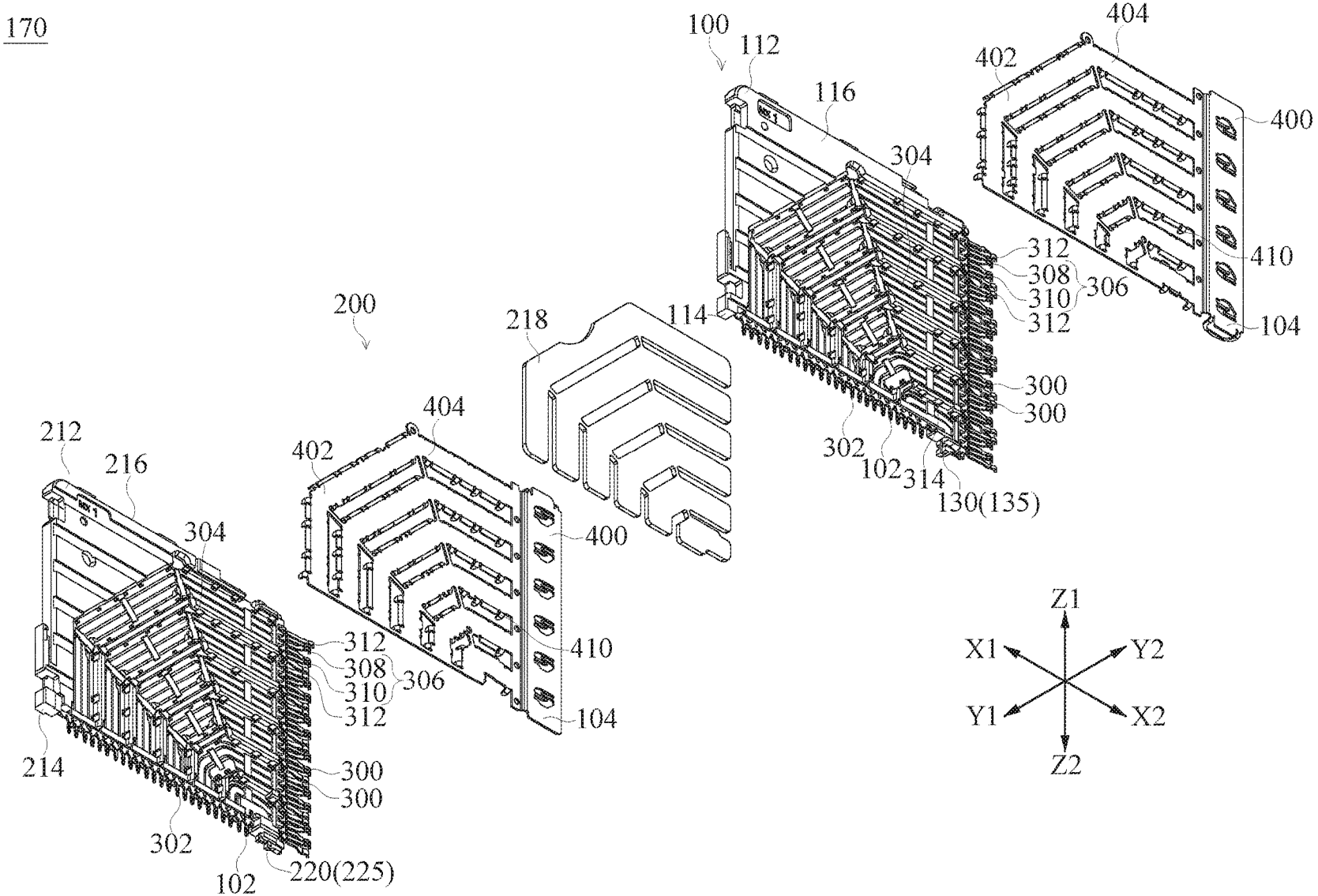
FIG. 17 illustrates an exploded perspective schematic view with respect to the wafer group shown in FIG. 12.

FIG. 17 illustrates an exploded perspective schematic view with respect to the wafer group 170 shown in FIG. 12. Referring to FIG. 17, the first wafer 100 includes an insulating frame 116, a part of the insulating frame 116 is implemented as the limiting block 135 of the first mate limiting structure 130. The second wafer 200 includes an insulating frame 216. A part of the insulating frame 216 is implemented as the latching block 225 of the second mate limiting structure 220. In some embodiments, the first wafer 100 and the second wafer 200 are retained with each other by engaging concave-convex structures on the insulating frame 116 and the insulating frame 216. In addition, each of the first wafer 100 and the second wafer 200 includes terminals 102 and a shield member 104.

Each terminal 102 of the first wafer 100 is fixed to the insulating frame 116 and shielded by the shield member 104 of the first wafer 100. Specifically, the insulating frame 116 and the shield member 104 of the first wafer 100 are aligned with each other, so that the shield member 104 shields each terminal 102 of the first wafer 100.

Each terminal 102 of the second wafer 200 is fixed to the insulating frame 216 and shielded by the shield member 104 of the second wafer 200. Specifically, the insulating frame 216 and the shield member 104 of the second wafer 200 are aligned with each other, so that the shield member 104 shields each terminal 102 of the second wafer 200.

Each terminal 102 includes a contact portion 300, a tail portion 302 extending out from the terminal mounting base 152 (as shown in FIG. 1) and a main body portion 304 connecting the contact portion 300 and the tail portion 302. In this embodiment, the contact portion 300 has a double arm contact system, the double arm contact system can reduce insertion force and improve reliability of contact mate interface, but this contact system is optional.

The terminals 102 includes at least a signal terminal pair 306 and at least a ground terminal 312 electrically connected with the shield member 104, wherein the signal terminal pair 306 is composed of signal terminals 308 and 310.

The shield member 104 includes a front portion 400 and a rear portion 402. The front portion 400 is configured to shield the contact portions 300 of the terminals 102 of the first wafer 100 and the second wafer 200 adjacent to each other, the rear portion 402 is configured to shield the main body portions 304 of the terminals 102 of the first wafer 100 and the second wafer 200 adjacent to each other.

The shield member 104 further includes a plate body 404 and finger portions 410 extending out from the plate body 404. Each finger portion 410 is configured to directly electrically connected with each hole 314 (as shown in FIG. 17) of the ground terminal 312, accordingly, the ground terminal 312 and the shield member 104 are grounded.

The connector 1 further includes an isolating plate 218 positioned between the first wafer 100 and the second wafer 200. In this embodiment, the isolating plate 218 is provided in the second wafer 200, wherein the shield member 104 of the second wafer 200 is positioned between the terminals 102 of the second wafer 200 and the isolating plate 218. However, the present disclosure is not limited thereto. In some embodiments, the isolating plate 218 can be independent of the first wafer 100 and the second wafer 200.

Features of some embodiments are generalized in above content, so that a person skilled in the art may better understand various aspects of the disclosed content of the present disclosure. A person skilled in the art of the present disclosure shall understand that the disclosed content of the present disclosure may be easily used as a basis, so as to design or modify other manufacturing approach or configuration and in turn to realize the same object and/or attain the same advantage as the embodiments of the present disclosure. A person skilled in the art shall also understand that, such an equivalent system configuration cannot be departed from the spirit and scope of the disclosed content of the present disclosure, and a person skilled in the art may make various changes, substitutions and replacements, which are not departed from the spirit and scope of the disclosed content of the present disclosure.

The invention claimed is:

1. A connector, comprising:

a housing comprising a top wall and a bottom wall separated with each other in a mounting direction; and wafers mated to the housing in a mating direction and supported by the housing, the wafers comprising:

a first wafer configured to be limited in the mounting direction; and a second wafer configured to be limited in the mating direction;

wherein response to that the first wafer is limited in the mounting direction, the second wafer is limited in the mounting direction; and wherein response to that the second wafer is limited in the mating direction, the first wafer is limited in the mating direction.

2. The connector of claim 1, wherein each of the top wall and the bottom wall of the housing comprises a first limiting structure and a second limiting structure;

each of a top portion and a bottom portion of the first wafer comprises a first mate limiting structure configured to be matched with the first limiting structure so as to limit the first wafer in the mounting direction;

each of a top portion and a bottom portion of the second wafer comprises a second mate limiting structure configured to be matched with the second limiting structure so as to limit the second wafer in the mating direction.

3. The connector of claim 2, wherein the first wafer and the second wafer are retained with each other.

4. The connector of claim 3, wherein the connector further comprises:

a retaining piece configured to retain the first wafer and the second wafer with each other.

5. The connector of claim 2, wherein the first limiting structure comprises a top end and a bottom end separated with each other along the mounting direction, widths of the top end and the bottom end in an arranging direction of the wafers are different from each other.

6. The connector of claim 5, wherein when the first limiting structure does not pass through the top wall or the bottom wall in the mounting direction, the first limiting structure comprises a limiting groove.

7. The connector of claim 5, wherein when the first limiting structure passes through the top wall or the bottom wall in the mounting direction, the first limiting structure comprises a limiting opening.

8. The connector of claim 2, wherein the first mate limiting structure comprises a limiting block.

9. The connector of claim 2, wherein the second mate limiting structure comprises a latching block.

10. The connector of claim 2, wherein a shape of the first limiting structure and a shape of the first mate limiting structure comprise T-shape, V-shape or dovetail shape.

11. The connector of claim 2, wherein the second limiting structure comprises a latching groove and a latching hole communicated with the latching groove, when the latching hole does not pass through the top wall or the bottom wall in the mounting direction, the latching hole comprises a blind hole.

12. The connector of claim 2, wherein the second limiting structure comprises a latching groove and a latching hole communicated with the latching groove, when the latching hole pass through the top wall or the bottom wall in the mounting direction, the latching hole comprises a through hole.

13. The connector of claim 1, wherein each of the first wafer and the second wafer comprises an insulating frame and terminals fixed with the insulating frame.

14. The connector of claim 13, wherein the terminals comprise at least a signal terminal pair and at least a ground terminal.

15. The connector of claim 14, wherein each of the first wafer and the second wafer further comprises a shield member electrically connected the ground terminal.

16. The connector of claim 13, wherein the connector further comprises a isolating plate positioned between the first wafer and the second wafer.

17. The connector of claim 16, wherein the isolating plate is provided in the second wafer, the shield member of the second wafer is positioned between the terminals of the second wafer and the isolating plate.

* * * * *